US005417608A

United States Patent [19]

Elliott

[11] Patent Number: 5,417,608

[45] Date of Patent: May 23, 1995

[54] BLAST CLEANING APPARATUS AND METHOD WITH LATERALLY MOVING CONVEYOR

[75] Inventor: Charles P. Elliott, Acton, Canada

[73] Assignee: Blast Cleaning Products Ltd., Oakville, Canada

[21] Appl. No.: 303,754

[22] Filed: Aug. 18, 1994

Related U.S. Application Data

[62] Division of Ser. No. 114,905, Sep. 2, 1993, Pat. No. 5,360,486.

[51] Int. Cl.[6] ..... B24C 3/14

[52] U.S. Cl. ..... 451/81; 451/75; 451/89; 451/96; 451/38; 451/39; 134/7; 134/9

[58] Field of Search ..... 451/36, 38, 39, 40, 451/75, 80, 81, 89, 91, 95, 96, 97; 134/6, 7, 9

[56] References Cited

U.S. PATENT DOCUMENTS

| | | | |
|---|---|---|---|
| 3,676,565 | 10/1972 | Claeys | 51/320 |
| 3,921,336 | 11/1975 | Nishio | 51/431 |
| 4,161,086 | 7/1979 | Toedtli | 51/418 |
| 4,513,597 | 4/1985 | Kimoto | 51/418 |
| 5,203,124 | 4/1993 | Carpenter | 51/410 |

OTHER PUBLICATIONS

Blast Cleaning Products Ltd., "Wire Mesh Conveyor Blast Machines", whole document.

Blast Cleaning Products Ltd., "Four Wheel Wire Mesh Conveyor Blast Machine", whole document.

*Primary Examiner*—Bruce M. Kisliuk
*Assistant Examiner*—Eileen P. Morgan
*Attorney, Agent, or Firm*—Riches, McKenzie & Herbert

[57] ABSTRACT

This invention relates to a blast cleaning apparatus and method which includes a laterally moving conveyor with openings therethrough, and particularly a laterally moving wire mesh conveyor. The conveying surface is moved laterally such that there is lateral movement of the conveyor surface in the blast cleaning chamber. The lateral movement is relative to the workpiece and is substantially horizontal and substantially transverse to the direction of advancement of the conveyor. The conveying surface is moved relative to the workpiece so as to expose to upwardly directed cleaning material areas of the workpiece that would otherwise be protected from the cleaning material by material separating the openings in the conveying surface.

10 Claims, 2 Drawing Sheets

BLAST CLEANING APPARATUS AND METHOD WITH LATERALLY MOVING CONVEYOR

This is a divisional of Ser. No. 08/114,905, filed Sep. 2, 1993, now U.S. Pat. No. 5,360,486.

BACKGROUND OF THE INVENTION

This invention relates to an apparatus and method for blast cleaning various metallic workpieces. Specifically, the invention relates to a method and apparatus incorporating a laterally moving conveying means.

SUMMARY OF THE INVENTION

In the past, a typical blast cleaning apparatus included some sort of conveying means which conveyed the workpiece to be cleaned into and through the blast cleaning chamber. Abrasive material (usually pellets) was typically directed at the piece to be cleaned, typically from several sources located within the cleaning chamber. The pellets would hit and clean the workpiece. Typically, if there were a blastwheel located below the conveying surface, a workpiece located on the conveying surface would be protected by the conveying surface from the cleaning pellets coming from below.

One solution to this problem was to use a conveying surface that had openings therethrough to allow the upwardly directed cleaning material to contact the workpiece. One preferred conveying surface was wire mesh conveying surface. The wire mesh conveying surface had a plurality of openings therethrough which allowed the cleaning pellets from below to pass through the conveying surface and to hit and clean the bottom of the workpiece which would otherwise have been totally protected by the conveying surface.

The solution of using a wire mesh conveying surface (or a conveying surface with openings therethrough) the lateral movement is relative to the workpiece and in a second direction which is substantially horizontal and substantially transverse to the first direction of movement of the conveying surface so as to expose to the cleaning material at least some area of the workpiece that would otherwise be protected from the cleaning materials by the material separating the openings in the conveying surface; wherein the lateral movement of the conveying surface is a back to forth movement relative to the piece; wherein the lateral movement comprises a lateral acceleration of the conveying surface during each of the back and forth movements so as to overcome frictional forces between the workpiece and the conveying surface in each of the back and forth directions; and wherein the accelerations in each of the back and forth directions are substantially equal such that the workpiece remains substantially in the same location on the conveying surface after a period of movement.

Also, in another of its broad aspects, this invention resides in providing a method of blast cleaning a workpiece to be cleaned comprising:

conveying the workpiece to be cleaned through a blast cleaning chamber on a conveying surface, wherein the conveying surface moves horizontally in a first direction through the cleaning chamber and has a plurality of openings therethrough and adjacent openings aligned in a second direction transverse to the first direction of movement of the conveying surface are separated by a separating material having a width;

when the workpiece is in the cleaning chamber, directing abrasive cleaning material upwardly through the openings in the conveying surface so as to clean areas of the workpiece exposed to the cleaning material;

when the workpiece is in a region where the cleaning material cleans the workpiece, causing the conveying surface to move laterally, this lateral movement being within the cleaning chamber at the region where the cleaning material cleans the workpiece, and wherein the lateral movement is relative to the workpiece in a second direction which is horizontal and transverse to the first direction of movement of the conveying surface so as to expose to cleaning material areas of the workpiece that would otherwise be protected from the cleaning material by the material separating the openings in the conveying surface; and wherein the lateral movement is a back and forth movement relative to the workpiece and comprises a lateral acceleration of the conveying surface during each of the back and forth movements so as to overcome frictional forces between the workpiece and the conveying surface in each of the back and forth directions and wherein the accelerations in each of the back and forth directions are equal such that the workpiece remains in the same location on the conveying surface after a period of movement.

Further aspects of the invention will become apparent upon reading the following detailed description and the drawings which illustrate the invention and preferred embodiments of the invention.

BRIEF DESCRIPTION OF THE DRAWINGS

In the drawings, which illustrate embodiments of the invention.

DETAILED DESCRIPTION OF PREFERRED EMBODIMENTS OF THE INVENTION

Figure 1:
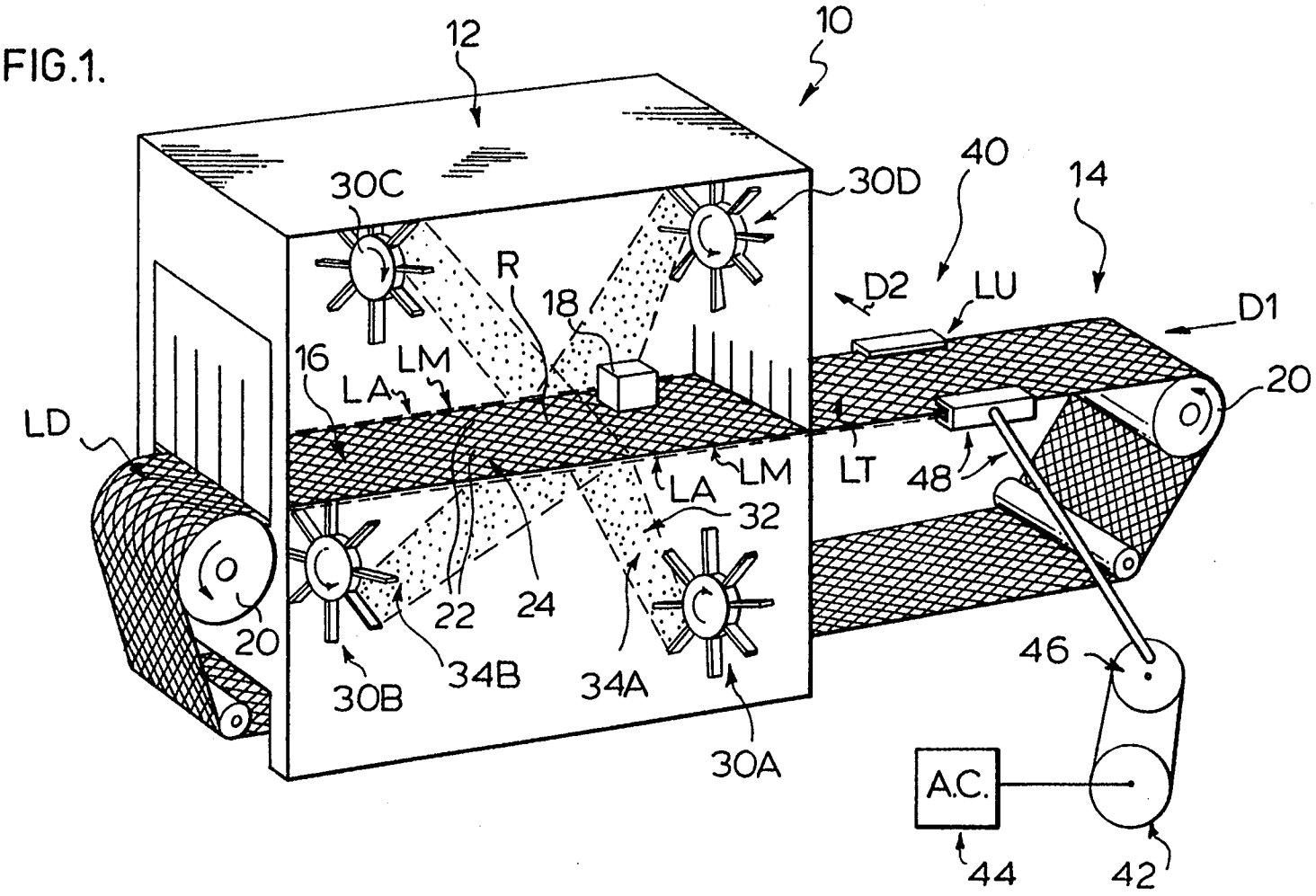
FIG. 1 is a schematic perspective view of an embodiment of the apparatus of the invention where one side of the cleaning chamber is removed.

As shown in FIG. 1, a blast cleaning apparatus 10 of the invention comprises a blast cleaning chamber 12 of the type normally used for blast cleaning.

There is also a conveying means 14 of the type normally used for blast cleaning. The conveying means 14 comprises a conveying surface 16. The conveying surface 16 is movable substantially horizontally in a first direction D1 into, through and out of the blast cleaning chamber 12 to convey through the cleaning chamber 12 a workpiece 18 to be cleaned.

Preferably, the conveying means 14 comprises some form of guides, such as rollers 20, to guide the conveying surface 16. The conveying means 14 will typically include some sort of driving force, such as a motor (not shown), to move the conveying surface as desired.

Preferably, the conveying surface 16 is a continuous surface, but it need not be.

The conveying surface 16 has a plurality of openings 22 through the conveying surface 16. Adjacent openings 22 aligned in a second direction D2, which is substantially transverse to the first direction D1 of movement of the conveying surface 16, are separated by a separating material 24 having a width W in the 2 direction (see FIG. 2).

Figure 2:
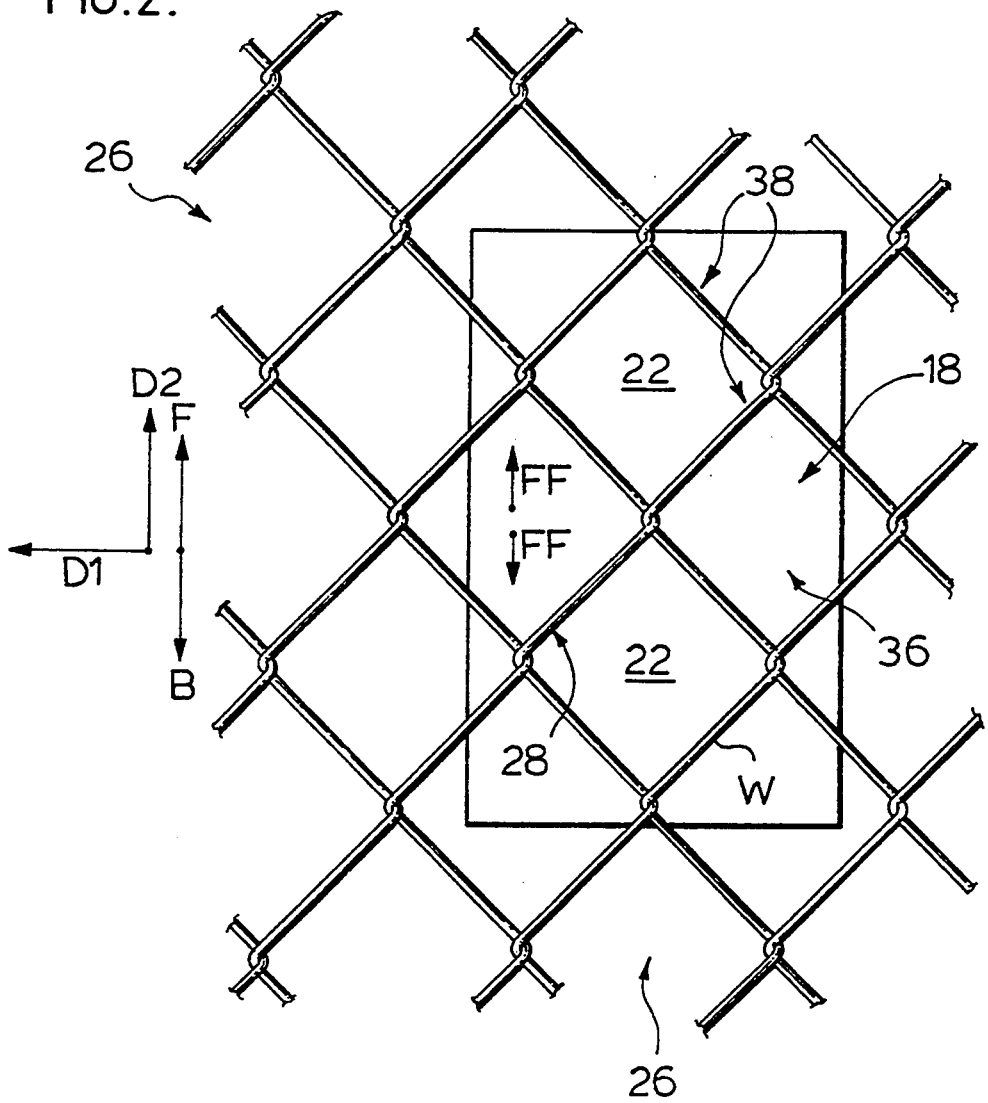
FIG. 2 is a partial bottom view of a wire mesh conveying surface with a workpiece positioned on the conveying surface.

In a preferred embodiment of the invention, the conveying surface 16 is a wire mesh 26 formed of wire strands 28, as best seen in FIG. 2 which is a partial bottom view of the wire mesh 26. In this embodiment, the openings 22 are the openings 22 between the strands of wire 28 and the material 24 separating the openings 22 is the wire strands 28.

The wire mesh conveyor 26 preferably has openings 22 which are approximately parallelograms of about 2 inches on each side. Preferably the wire strands 28 are made of manganese steel. Preferably there is about 11 to 13% manganese in the steel wire.

Preferably, the wire mesh 26 is woven.

Preferably, the width W of the individual wire strands 28 is about 3/16th of an inch.

The workpiece 18 will vary in size and shape. Typically, the workpiece is an automotive piece measuring about 18 by 9 by 3 inches. Typically, the width of the conveying surface 16 (in the direction D2) is about 2 to 4 feet.

Depending on the size, shape and weight of the workpiece 18, the conveying surface 16 moves into, through and out of the cleaning chamber 12 and blast stream 34 at a preferred rate of about 5 to 10 feet per minute. Preferably there is a variable control (not shown) to control the rate of movement of the conveying surface 16 in the direction D1.

Other types of conveying surfaces 16 with openings 22 and separating material 24 are within the scope of the invention.

Inside the cleaning chamber 12 is located at least one blastwheel to direct abrasive cleaning material, preferably pellets 32, upwardly at the workpiece 18. The pellets are typically metallic and are in the range of about 17/1000ths to 33/1000ths of an inch in diameter.

As shown in FIG. 1, in one preferred embodiment, there are four blastwheels 30A to 30D. All of the blastwheels 30 direct the cleaning pellets 32 into regions of the cleaning chamber 12 where the pellets 32 clean the workpiece 18. The pellets 32 are directed along a pellet stream 34 or blast stream (as shown by dashed lines in FIG. 1). The region R is that region where the pellets from the blastwheel or blastwheels 30A, 30B directing pellets upwardly clean the workpiece 18.

When the workpiece 18 is conveyed by the conveying surface 16 through the blast streams 34, the pellets 32 clean the workpiece 18. In order to clean as much of the surface of the workpiece 18 as possible, blastwheels 30 direct pellets at the workpiece 18 from as many directions as is feasible. As shown in FIG. 1, two blastwheels 30A, 30B direct cleaning pellets upwardly through the openings 22 in the conveying surface 16. However, it is possible that there is only one blastwheel directing cleaning material 32 upwardly through the openings 22 in the conveying means 16.

The pellets 32 which are directed upwardly through the openings 22 of the conveying surface 16, in the region R, clean at least a portion 36 of the workpiece 18. The portion 36 of the workpiece 18 is typically the underside of the workpiece 18, or whatever surfaces of the workpiece 18 are exposed to upwardly directed pellets, as shown in FIG. 2 which is a bottom view (looking upwardly) of the conveying surface 16 and the workpiece 18.

Without lateral movement LM of the conveying surface 16 as provided by the present invention, the workpiece 18 does not move relative to the conveying surface 16. Thus, when the workpiece 18 is conveyed through the upwardly directed pellet stream 34A or 34B, the material 24 separating the openings 22, and specifically the wire strands 28, acts as a "mask" and prevents the pellets 32 from properly contacting and cleaning those areas 38 of the surface of the workpiece 18 that are protected by the separating material 24 (refer to FIG. 2).

In fact, if a workpiece with a flat bottom surface is placed on a conveying surface 16 with the flat surface down, and if this workpiece is passed through an upwardly directed pellet stream, a definite pattern of cleaned and uncleaned areas is apparent. The uncleaned area 38 will have a pattern or "shadow" substantially the same as the pattern of the separating material 24 between the openings 22 of the conveying surface 16.

In order to overcome the disadvantage of the "shadow" caused by the separating material 24, it has been determined that, if the conveying surface 16 is moved substantially laterally (that is substantially transversely to the direction D1 of advancement of the conveying surface 16) within the cleaning chamber 12 at the region R where the upwardly-directed pellets 32 clean the workpiece 18, there is improvement in the cleaning of the previously uncleaned areas 38 of the workpiece 18. It has been found that the use of the invention improves the cleaning of most, if not virtually all, workpieces and also allows the cleaning of some workpieces that otherwise could not previously be cleaned by way of blast cleaning.

The lateral movement LM (as shown schematically by dashed lines in FIG. 1) of the conveying surface 16 is relative to the workpiece 18 and is in a second direction D2 which is substantially horizontal and substantially transverse to the first direction D1 of the movement of the conveying surface 16. The lateral movement LM is such so as to expose to the upwardly directed cleaning material 32 at least some of the area 38 of the workpiece 18 that would otherwise be protected from the cleaning material 32 by the material 24 separating the openings 22 in the conveying surface 16. Preferably, the lateral movement exposes for cleaning as much of the area 38 as possible.

Preferably, the substantially lateral movement LM of the conveying surface 16 is a periodic back and forth movement relative to the piece 18. Thus, the conveying surface 16 moves "forth" in the positive D2 direction (or negative D2 direction) and then moves "back" in the opposite or negative D2 direction (or positive D2 direction).

Preferably the total lateral movement LM of the conveying surface 16, in either the back or the forth direction, is of a distance of at least about the width W of the material 24 separating the opening 22 of the conveying surface 16. In this manner, the conveying surface 16 moves sufficiently laterally so as to expose all of the area 38 to upwardly directed cleaning material 32. Thus, the material 24 separating the openings 22 will move, relative to the workpiece 18, a distance W, being the width of the material 24 separating the openings 22.

In the preferred embodiment where the separating material 24 is the wire strands 28, the conveying surface 16 moves laterally a distance of about the width W of the strands 28. Thus, in a preferred embodiment where the wire strands 28 are about 3/16th inches in diameter, it is preferred that the conveying surface 16 will move laterally at least about 3/16th of an inch or slightly more.

The conveying surface 16 may move laterally more than the width W of the material 24 separating the openings. It is preferred, however, that the conveying surface 16 move laterally no more than, and preferably less than, the width of the openings 22 in the direction D2.

Preferably the lateral movement LM of the conveying surface 16 comprises a lateral acceleration LA (shown schematically by dashed lines in FIG. 1) of the conveying surface 16 during each of the back and forth movements so as to overcome frictional forces FF between the workpiece 18 and the conveying surface 18 in each of the back and forth directions B,F. The lateral acceleration LA takes place within the cleaning chamber 12 at the region R where the upwardly directed cleaning material 32 cleans the workpiece 18.

The conveying surface 16 should be accelerated sufficiently such that the conveying surface 16 moves relative to the workpiece 18.

Preferably the lateral accelerations LA in each of the back and forth directions B,F are substantially equal such that the workpiece 18 remains substantially in the same location L on the conveying surface 16 after a period of lateral movement, but the conveying surface as moved at least about, or slightly more than, the width W of the separating material 24 and slightly less than the width of the openings in the D2 direction.

Thus, the conveying surface 16 is accelerated in, for example, the "forth" direction (positive D2 direction) a certain distance and then the conveying surface 16 is accelerated in the opposite direction, the "back" direction (negative D2 direction). If the accelerations in each of the back and forth directions are substantially the same over the period of movement, the workpiece 18 will remain substantially in the same location on the conveying surface 16. If the accelerations are not substantially equal, the workpiece 18 will tend to drift to one edge or the other of the conveying surface 16. If this happens, the full benefit of the pellet streams 34 is not obtained as the workpiece 18 passes through the pellet streams 34.

As can be appreciated, any lateral movement LM or lateral acceleration LA of the conveying surface 16 relative to the workpiece 18 will be advantageous. However, it is preferred that the conveying surface 16 will move back and forth somewhere in the range of about 200 to 900 times per minute. It is even more preferred that the conveying surface 16 moves laterally back and forth somewhere in the range of about 500 to 700 times per minute. It is even more preferred that the conveying surface 16 moves laterally back and forth about 600 times per minute.

Although the lateral movement LM of the conveying surface 16 takes place in the region R where the upwardly directed pellets 32 clean the workpiece 18, the lateral movement LM may actually be caused at a location other than the region R. Specifically, it is preferred that the moving means 40 which causes, and which is capable of causing, the lateral movement LM (and the lateral acceleration LA) be located outside of the pellet stream 34 or, in other words, outside of any blast stream of cleaning material 32. Thus, the moving means 40 may be located within the cleaning chamber 12, but outside of the pellet stream 34.

Even more preferable, however, is that the moving means 40 be located outside of the cleaning chamber 12. The reason for this preferred location is so that the moving means 40 will not be damaged or affected by the abrasive material 32, either directly or indirectly when the pellets rebound from other material. Thus, to have the moving means 40 actually physically located within the cleaning chamber 12 but protected or covered by a protective material would be considered to have the moving means 40 located outside of the cleaning chamber 12.

Because the moving means 40 will not usually be located in the region R, it is necessary that there is sufficient longitudinal tension LT in the conveying surface 16, and particularly when the conveying surface 16 is a wire mesh 26, so as to propagate the lateral movement LM (and lateral acceleration LA) to the region R of the conveying surface 16 where the upwardly directed pellets 32 clean the workpiece 18. The appropriate longitudinal tension LT will depend on many factors and can be readily determined for the particular apparatus and application.

The moving means 40 can be any suitable means which causes the lateral movement LM (and lateral acceleration LA) as desired. If the lateral movement LM is a pulsed movement, hydraulic or pneumatic cylinders could be Used. The term "pulsed" lateral movement is intended to mean and include lateral movement where the lateral movement in the back (or forth direction) is not of the same duration in time as the duration in time of the lateral movement in the opposite direction, namely the forth (or back) direction.

Where the lateral movement LM is not pulsed, it is preferred that some sort of rotary movement source is transformed into a linear force which causes the lateral movement LM. Preferably, the moving means 40 comprises at least one variable speed motor 42 controlled by an AC variable frequency 44, an eccentric drive 46 and a coupling means 48 from the drive 46 to the conveying surface 16.

Preferably there is only one moving means 40 which causes the lateral movement LM. Preferably the moving means 40 causes the lateral movement LM of the conveying surface 18 to be caused at a location upstream LU of the region R where the upwardly directed cleaning material 32 cleans the workpiece 18 and preferably outside of the cleaning chamber 12.

However, it is possible to have more than one moving means 40, or to have the moving means 40 cause the lateral movement LM at two distinct locations on the conveying surface 16. Preferably, in such a circumstance, the moving means 40, or second moving means (not shown), would also cause the lateral movement LM of the conveying surface 18 to be caused at a second location LD which is downstream of the region R where the upwardly directed pellets clean the workpiece 18, and preferably outside of the cleaning chamber 12.

The blast cleaning apparatus 10 of the invention is used by placing the workpiece 18 onto the conveying surface 16 and conveying the workpiece 18 through the blast cleaning chamber 12 on the conveying surface 16.

When the workpiece 18 is in the cleaning chamber 12, abrasive cleaning material 32 is directed, at least upwardly through the openings 22 in the conveying surface 16, so as to clean area 36 of the workpiece exposed to the upwardly directed cleaning material 32.

When the workpiece 18 is in the region R where it is to be cleaned by the upwardly directed cleaning material, the conveying surface 16 is caused to move substantially laterally as described above. Thus, the conveying surface 16 and the workpiece 18 move relative to each other such that the portions 38 of the workpiece 18 which would otherwise be hidden by the separating material 24 from the upwardly directed pellets 32 are then exposed to the cleaning material 32, thus improving the cleaning of the portion 36, and particularly the portions 38, of the workpiece 18.

It is preferable to cause the conveying surface 16 to move substantially laterally at all times during cleaning operations of the apparatus 10. This is because the cleaning process tends to be a continuous process. For example, usually a first workpiece 18 is placed onto the conveying surface 16 and then a second workpiece (not shown) is placed onto the conveying surface 16 behind the first workpiece, and then a third workpiece (not shown) is placed behind the second. This process typically continues while the apparatus 10 is in use. Each of the workpieces is cleaned as described above with respect to the first workpiece 18.

It will be understood that, although various features of the invention have been described with respect to one or another of the embodiments of the invention, the various features and embodiments of the invention may be combined or used in conjunction with other features and embodiments of the invention as described and illustrated herein.

Although this disclosure has described and illustrated certain preferred embodiments of the invention, it is to be understood that the invention is not restricted to these particular embodiments. Rather, the invention includes all embodiments which are functional or mechanical equivalents of the specific embodiments and features that have been described and illustrated herein.

I claim:

1. A blast cleaning apparatus comprising:

a blast cleaning chamber;

a conveying means comprising a conveying surface moveable horizontally in a first direction into, through and out of the blast cleaning chamber to convey through the cleaning chamber a workpiece to be cleaned; and wherein the conveying surface has a plurality of openings therethrough and adjacent openings aligned in a second direction transverse to the first direction of movement of the conveying surface are separated by a separating material;

at least one blast cleaning means located within the cleaning chamber and oriented to direct abrasive cleaning material upwardly through the openings of the conveying surface to clean at least a portion of the workpiece;

a moving means capable of causing lateral movement of the conveying surface, this lateral movement being within the cleaning chamber at a region where the abrasive cleaning material cleans the workpiece, wherein the lateral movement is relative to the workpiece and in a second direction which is horizontal and transverse to the first direction of movement of the conveying surface so as to expose to the cleaning at least some material area of the workpiece that would otherwise be protected from the cleaning materials by the material separating the openings in the conveying surface;

wherein the lateral movement of the conveying surface is a back to forth movement relative to the piece;

wherein the lateral movement comprises a lateral acceleration of the conveying surface during each of the back and forth movements so as to overcome frictional forces between the workpiece and the conveying surface in each of the back and forth directions; and wherein the accelerations in each of the back and forth directions are substantially equal such that the workpiece remains substantially in the same location on the conveying surface after a period of movement.

2. A blast cleaning apparatus as defined in claim 1 wherein the back and forth movement is periodic relative to the piece; and wherein the separating material has a width in the second direction and the lateral movement is of a distance of at least about the width of the material separating the openings in the conveying surface.

3. A blast cleaning apparatus as defined in claim 2 wherein the conveying surface is wire mesh formed of wire strands and wherein the openings in the conveying surface are the openings between strands of wire and the material separating the openings is the wire strands.

4. A blast cleaning apparatus as defined in claim 3 wherein there is sufficient longitudinal tension in the wire mesh conveying surface so as to propagate the lateral movement to the region of the conveying surface where the cleaning material cleans the workpiece.

5. A blast cleaning apparatus as defined in claim 4 wherein the conveying surface moves back and forth laterally about 200 to 900 times per minute.

6. A blast cleaning apparatus as defined in claim 5 wherein the moving means is located outside of any path of cleaning material.

7. A blast cleaning apparatus as defined in claim 6 wherein the moving means is located outside of the cleaning chamber.

8. A blast cleaning apparatus as defined in claim 7 wherein the moving means comprises at least one variable speed motor controlled by an A.C. variable frequency, an eccentric drive and a coupling means from the drive to the conveying surface.

9. A blast cleaning apparatus as defined in claim 8 wherein the moving means causes the lateral movement of the conveying surface to be caused at a location upstream of the region where the cleaning material cleans the workpiece.

10. A blast cleaning apparatus as defined in claim 9 wherein the moving means also causes the lateral movement of the conveying surface to be caused at a second location which is downstream of the region where the cleaning material cleans the workpiece.

* * * * *